United States Patent [19]

Laverick

[11] Patent Number: 4,622,896

[45] Date of Patent: Nov. 18, 1986

[54] POWDER SPRAY GUN

[75] Inventor: William J. Laverick, Chula Vista, Calif.

[73] Assignee: Wizer Equipment, Inc., National City, Calif.

[21] Appl. No.: 718,237

[22] Filed: Apr. 1, 1985

[51] Int. Cl.[4] ..... B41F 35/00; B41L 41/00

[52] U.S. Cl. ..... 101/416 R; 101/416 A

[58] Field of Search ..... 101/416 B, 416 A, 416 R

[56] References Cited

U.S. PATENT DOCUMENTS

| | | | |
|---|---|---|---|
| 1,414,339 | 5/1922 | Cochrane | 101/416 R |
| 1,619,968 | 3/1927 | Carmichael | 101/416 A |
| 1,737,174 | 11/1929 | Price | 101/416 A |
| 1,836,536 | 12/1931 | Lance | 101/416 A |
| 1,955,055 | 4/1934 | Date | 101/416 A |
| 2,040,998 | 5/1936 | Jump | 101/416 R |
| 3,050,416 | 8/1962 | Yahnke et al. | 101/416 B |
| 3,275,196 | 9/1966 | Warczak | 101/416 R |
| 3,333,570 | 10/1964 | Paasche | 101/416 B |
| 3,606,087 | 9/1971 | Ortman | 101/416 B |
| 3,861,351 | 1/1975 | Bonwit et al. | 101/416 B |

*Primary Examiner*—William Pieprz
*Assistant Examiner*—Tonya Eckstine
*Attorney, Agent, or Firm*—Baker, Maxham & Jester

[57] ABSTRACT

A powder spray attachment for printing presses for mounting above the delivery tray comprises a cylindrical tube having a plurality of ports along the length thereof for mounting transverse to the delivery tray with a plurality of movable clamps on the tube for selectively closing selected ports for delivery of powder at selected positions along the width of sheets of paper delivered to the delivery tray.

4 Claims, 3 Drawing Figures

POWDER SPRAY GUN

BACKGROUND OF THE INVENTION

The present invention relates to printing presses and pertains particularly to a powder spray attachment for the delivery tray of a printing press.

Many small offset printing presses produce several hundred sheets per minute of printed copy which is stacked in a delivery tray as the sheets come out of the press. Some printing presses use a gravity feed delivery and others use a chain delivery feed for delivery of the sheets from the press to the delivery tray. The sheets, when they come from the press are usually still wet with ink and frequently the ink from one sheet will imprint the back of the next sheet. For this reason, spray attachments for spraying powder on the sheets as they are delivered into the tray are available for most machines. These attachments however usually comprises one or more open ended tubes that are directed into the delivery tray for blowing powder onto the sheets. Often times sheets which are printed have ink coverage only on certain areas. For this reason, it is frequently unnecessary to cover the entire sheet with powder.

Accordingly, it is desirable that some means be available for selectively delivering a spray powder to selected areas of printed sheets as they are ejected from a printing press.

SUMMARY AND OBJECTS OF THE INVENTION

It is accordingly the primary object of the present invention to provide an improved powder sprayer for printing presses.

In accordance with the primary aspect of the present invention, a spray attachment for spraying powder into the delivery tray of a printing press comprises an elongated tubular member having a plurality of spray ports and means for selectively closing selected ones of said ports for selectively delivering a spray of powder at selected areas on a sheet of paper.

BRIEF DESCRIPTION OF THE DRAWINGS

The above and other objects and advantages of the present invention will become apparent from the following description when read in conjunction with the drawings wherein:

Referring to FIG. 1 of the drawings, a spray attachment in accordance with the invention is illustrated in conjunction with a chain type delivery system of a printing press which is shown in phantom. The spray attachment can be used with any type sheet stacking or delivery system.

Illustrated FIG. 1 is a chain delivery unit shown in phantom for delivering sheets from a printing press into a tray where the sheets are stacked one on top of another. The tray comprises a pair of laterally spaced vertical side walls 12 and 14 with a sheet receiving tray, not shown, disposed beneath the side walls. A chain assembly 16 is mounted on suitable sprockets and the like and carries a series of grippers which grip the edges of sheets as they pass from the printing press pulling them out to a position above the sheet tray and releasing the sheets permitting them to fall on top of one another in the tray.

Figures 1, 2, 3:
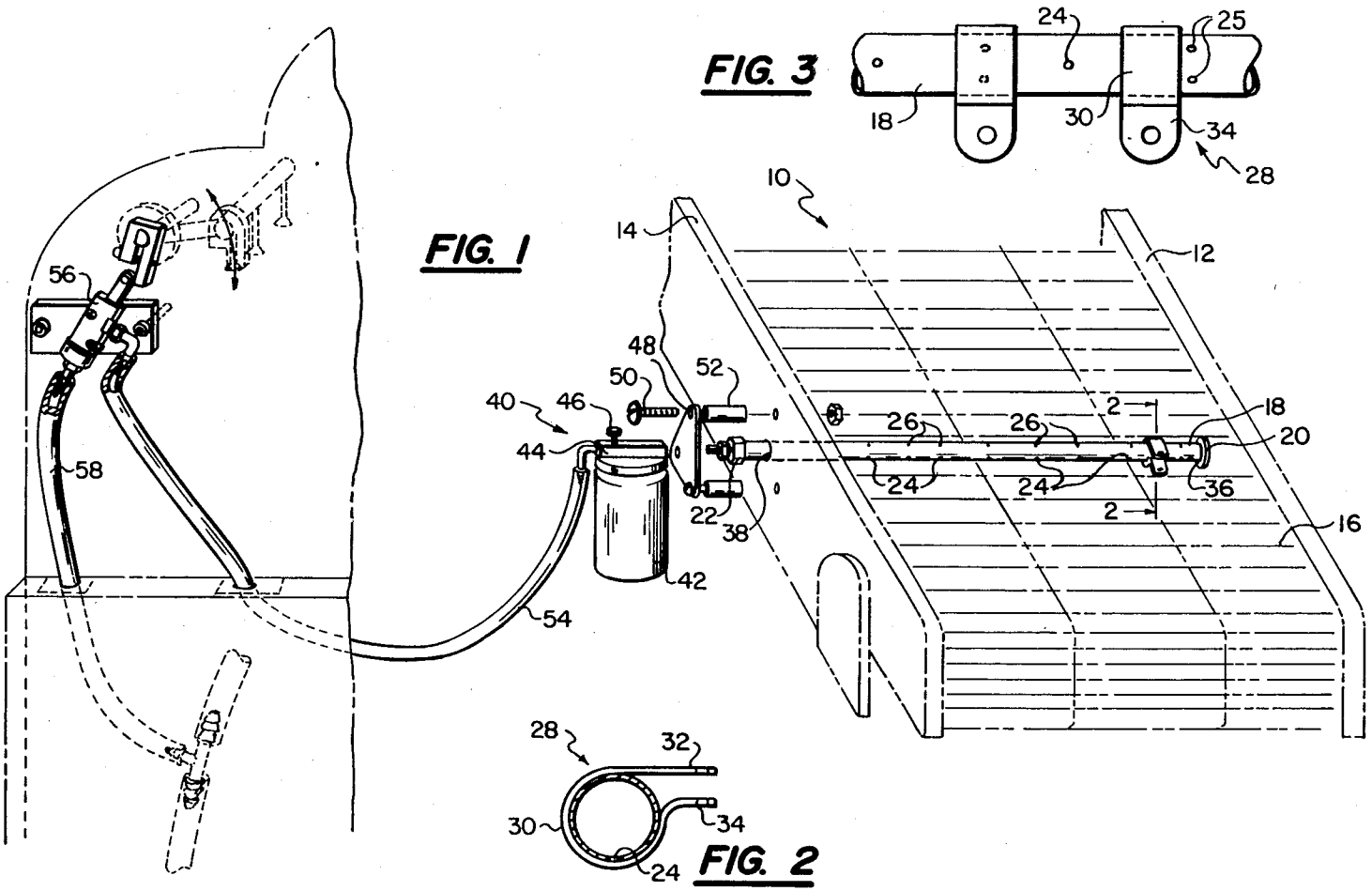
FIG. 1 is a perspective view of the spray attachment in accordance with the invention.
FIG. 2 is a section view taken generally on line 2—2 of FIG. 1 showing details of the clamp units; and, FIG. 3 is an enlarged partial view of the tube of FIG. 1.

The attachment in accordance with the present invention comprises an elongated cylindrical tube 18 having a distal end closed by a plug 20 and a proximal end equipped with a coupling fitting 22. A plurality of spray ports 24 are spaced along the length of the tube 18. These may be selectively positioned on the order of between one and two inches apart such that the spray can be selectively directed onto selective areas of sheets passing therebeneath. The ports are arranged in an alternate sequence of a single port 24 and a double or pair of ports 25 along the length of the tube. The single ports 24 are preferably directed toward the tray with the pairs 25 directed at slight angles in opposite directions along the length of the tray. Selected arrangements of ports such as 24 and 25 may be positioned at selective spaces along the length of the tube for arranging to direct the powder spray along the length of the sheet of paper. In addition, the tube or a plurality of the tubes may be mounted above the delivery tray at selected positions along the length thereof.

In order to control the opening of the ports, a plurality of circular clamps designated generally by the numeral 28 are provided on the tubes. These clamps are preferably of the type having a circular central portion 30 and a pair of end clamps 32 and 34. The clamps are preferably of a spring type that biases into a clamping position around the tube. With this arrangement, the clamps may be opened by pulling the tabs 32 and 34 apart, i.e., away from each other, thus releasing the clamping action of the clamp on the tube. The clamp may then be moved to a selected position covering one or more of the discharge ports or to a position between the ports, leaving the ports open. Thus, selected ones of the ports may be selectively closed by the positioning of the clamps.

Since the ports are located on the lower side of the tube it is desirable that some indicia of location for the ports be available. I have provided indicia in the form of a small indentation 26 that is colored such as red or any color different from the tube 18. These indicia are located directly opposite the respective ports so that they can be seen from above.

The tube 18 is selectively mounted in the printing press housing by extending through a pair of aligned bores in the side walls of the housing above the delivery tray. These bores 36 and 38 exist in most printing presses without the necessity of drilling holes. A powder spray unit 40 includes a removable powder container 42 and a spray top 44 having an adjustment valve 46 for adjusting the quantity of spray into the tube. The tube includes a fitting 22 which threadably engages a cooperative fitting in the top 44 of the spray unit. A mounting bracket including a substantially triangular shaped plate 48 mounted by a plurality of screws 50 and a plurality of standoff or spacer members 52 to the side of the housing.

Air is supplied to the sprayer from the discharge end of the vacuum pump for the printing machine. The typical printing machine has a vacuum pump for operating the pick-up fingers for feeding sheets into the machine. The discharge side of the pump is frequently used for providing air for spraying powder and for aiding the drying of the ink. In the illustrated embodiment, a supply line or tube 54 is connected to the spray unit 40 and to a source of pressurized air such as the discharge side of the vacuum pump. In this embodiment, the line 54 is shown connected to a valve unit 56 on the printing machine which in turn is supplied with pressurized air from a supply line 58 from the vacuum pump.

In operation, the attachment is put in position with the tube 18 mounted through the apertures in the side wall of the printing machine housing and attached by bracket 48 to the side wall of the machine. The powder spray unit 40 is attached to the end of the spray tube 18 and connected to a source of pressurized air. A plurality of clamps 28 are then selectively positioned either over selected discharge ports or adjacent thereto for selectively opening and closing the desired ports depending on the desired powder coverage on the sheets to be delivered to the tray. The positioning of the clamps determines the number and position of the open ports and thus location and quantity of the spray powder that is sprayed onto the sheet.

While I have illustrated and described my invention by means of specific embodiments, it is to be understood that numerous changes and modifications may be made therein without department from the spirit and scope of the invention as defined in the appended claims.

I claim:

1. An attachment for spraying powder onto sheets of paper being delivered to the delivery tray of a lithographic type printing press, said attachment comprising:

an elongated cylindrical tube for mounting above a sheet delivery tray of a printing press, said tube having a closed end, and an open end for connecting to a source of powder;

a source of powder carried by an air stream for supplying powder to said tube;

a plurality of spray ports formed alternately as a single port and as a pair of ports disposed along the length of said tube, and said pairs are positioned at different circumferential positions around said tube relative to said singles and are thereby at different angles relative to the axis of the tube than the singles for directing powder onto selected areas of sheets passing therebelow; and a plurality of circular tube clamps disposed along said tube for selectively covering selected ones of said ports.

2. A spray attachment according to claim 1 comprising indicia means on said tube opposite said ports for locating the position of said ports along said tube.

3. A spray attachment according to claim 2 wherein said indicia means comprises an indentation in said tube and distinctive colored means in said indentation.

4. A powder spray assembly for a sheet delivery tray of a lithographic type printing press comprising in combination:

a sheet delivery tray for receiving sheets of printed paper from a printing press;

an elongated cylindrical tube mounted above said delivery tray, said tube having a closed end, and an open end for connecting to a source of powder and air for carrying said powder;

a plurality of spray ports disposed along one side of said tube, said ports being formed alternately as a single port and as a pair of ports with the angle of the pair of ports relative to the axis of the tube being different from the angle of the single ports and said pair of ports being to each side of a line through the single ports;

indicia means on the opposite side of said tube from said ports for identifying the location of said ports, said indicia means including distinctive color means; and a plurality of circular spring clamps for placing over and closed selected ones of said ports for controlling the discharge of powder into said delivery tray.

* * * * *